United States Patent [19]

Full

[11] Patent Number: 4,498,858

[45] Date of Patent: Feb. 12, 1985

[54] HEATED DIE FOR CARBONIZED MATERIAL

[75] Inventor: Donald A. Full, Richmond, Va.

[73] Assignee: Philip Morris Incorporated, New York, N.Y.

[21] Appl. No.: 410,195

[22] Filed: Aug. 23, 1982

[51] Int. Cl.[3] ..... A01J 21/00

[52] U.S. Cl. ..... 425/466; 425/461

[58] Field of Search ..... 425/441, 461, 466

[56] References Cited

U.S. PATENT DOCUMENTS

| | | | |
|---|---|---|---|
| 567,606 | 9/1896 | Algea, Jr. et al. | 72/468 |
| 686,365 | 11/1901 | Thackraz | 72/468 |
| 1,577,015 | 3/1926 | Glaze | 425/466 |
| 2,289,787 | 7/1942 | Kaschke et al. | 264/56 |
| 2,784,453 | 3/1957 | Hjulian | 425/78 |
| 2,902,714 | 9/1959 | Johnson | 425/79 |
| 2,994,917 | 8/1961 | Fritsch | 425/79 |
| 3,134,832 | 5/1964 | Smith | 264/167 |
| 3,540,259 | 11/1970 | Hinshaw | 72/465 |
| 3,719,065 | 3/1973 | Fuchs, Jr. | 72/9 |
| 3,782,154 | 1/1974 | Fuchs, Jr. | 72/12 |
| 3,876,744 | 4/1975 | Onder | 264/105 |
| 3,901,641 | 8/1975 | Onder | 425/406 |

*Primary Examiner*—Paul Lieberman
*Assistant Examiner*—Willie Thompson
*Attorney, Agent, or Firm*—A. I. Palmer, Jr.; N. A. Blish

[57] ABSTRACT

A heated die (10) is divided into four segments slidable with respect to adjacent segments so that when opposing segments (12) and (16) move together and forward, segments (14) and (18) are moving out and back. Thus, friable material may be formed and drawn through die (10) by the action of the die.

6 Claims, 6 Drawing Figures

HEATED DIE FOR CARBONIZED MATERIAL

BACKGROUND OF THE INVENTION

This invention relates in general to dies and more particularly to a segmented die which may be used for friable carbonized material.

DESCRIPTION OF THE PRIOR ART

Dies have been used in manufacturing for various purposes. For example, in a conventional wire drawing operation, a rod is pulled through a series of drawing dies and is thereby successfully reduced in diameter until the desired wire size is obtained. A problem with this method is that the material being pulled through the drawing die must have a certain degree of ductility so that it is not torn apart as it is pulled through the die. A material that would not be suitable for passing through a drawing die would be carbonized cellulose.

Dies are also used for extrusion. The purpose of the extrusion die is to reduce the diameter of the material being forced through the die and to compact the material into a rod or a tube. This method is suitable for particulate material or metal sponge which is to be compacted in the die. However, this method would be unsuitable for other materials such as moist cellulosic rods such as described in U.S. Pat. No. 4,219,031.

It is, therefore, an object of the present invention to provide a die which may be used to form and treat a material having low tensil strength.

It is also an object of the present invention to provide a die that may be used to treat and shape a material that is not suitable for use with an extrusion process.

Yet another object of the present invention is to provide a die that will move the treated material through the die at the same time the material is being formed and treated.

SUMMARY OF THE INVENTION

According to the present invention, the foregoing and other objects are obtained by providing a die that is divided into segments which move in such a manner that opposing segments move in and forward as adjacent segments move out and back. At the completion of the in and forward motion, this first set of segments moves out and back as the adjacent segments move in and forward thereby compressing and moving the material in the die forward. The die is heated in order to carbonize the material passing through.

BRIEF DESCRIPTION OF THE DRAWINGS

A more complete appreciation of the invention and many of the attendent advantages thereof will be readily apparent by reference to the following detailed description when considered in connection with the accompanying drawings wherein.

DESCRIPTION OF THE PREFERRED EMBODIMENT

Figure 1:
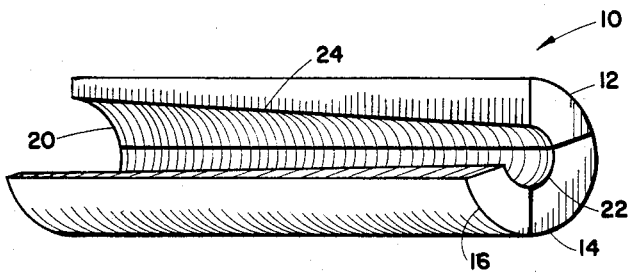
FIG. 1 is a perspective view partially broken away of a die according to the present invention.
Figure 2:
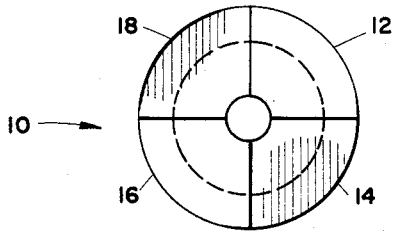
FIG. 2 is an end view partially in phantom of the invention shown in FIG. 1.

Referring now more particularly to the drawings and specifically to FIG. 1 there is illustrated a preferred embodiment of the invention as would be used in a heated die designated generally by the numeral 10. Die 10 is divided into four segments 12, 14, 16, and 18. The four segments are of approximately equal dimensions. The exterior of the die 10 is approximately cylindrical in shape when the die segments are at rest as shown in FIG. 1 and FIG. 2.

Bore 24 lies along the axis of die 10 and is approximately circular in shape and is tapered from bore inlet 20 to bore outlet 22. In the preferred embodiment of the invention, inlet bore 20 is approximately 4 cm and outlet bore 22 is approximately 0.8 cm. The overall length of die 10 is approximately 30 cm. Thus, the rate of taper in the preferred embodiment is 0.1 cm per cm.

In order to carbonize gathered cellulosic material that has been treated in a manner described in U.S. Pat. No. 4,219,031 to Rainer, it is necessary to pass the cellulosic material through a heated die. Since the moist cellulosic material has little axial rigidity it cannot be forced through the die from the inlet to the outlet. After the carbonization, the cellulosic material has little axial strength, therefore, it cannot be drawn through the heated die. Thus, the carbonized material must be moved through the die by movement of the die itself.

Figure 3:
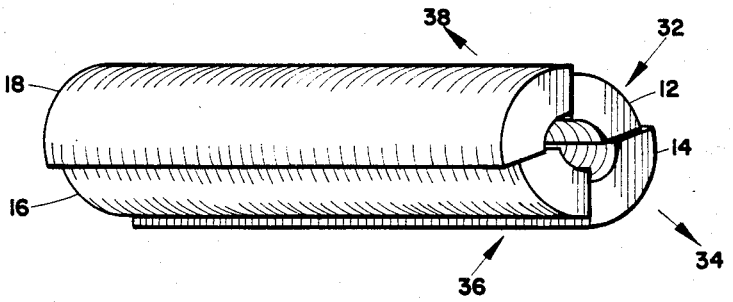
FIG. 3 is a perspective view of the invention shown in FIG. 1 wherein first segments have moved inward and adjacent segments have move outward.

As shown in FIG. 3, die segments 12 and 16 move inward as shown by arrows 32 and 36 while die segments 14 and 18 move outward as shown by arrows 34 and 38. As segments 12 and 16 move inward, they grip and compress the cellulosic material, not shown, in tapered bore 24.

Figure 4:
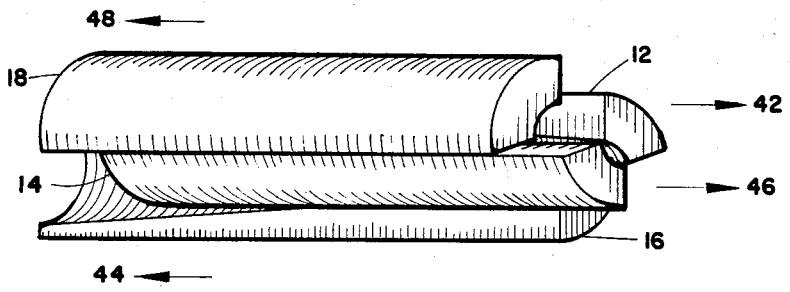
FIG. 4 is a perspective of the invention shown in FIG. 1 wherein the first segments have moved all the way forward and adjacent segments have moved all the way rearward.

As shown in FIG. 4, segments 12 and 16 move forward as shown by arrows 42 and 46 as segments 14 and 18 move back, as shown by arrows 44 and 48. Thus, the cellulose is being heat treated by die segments 12 and 16 as it is moved forward. The method of heating die 10 may be any suitable method such as is well known in the art.

Figure 5:
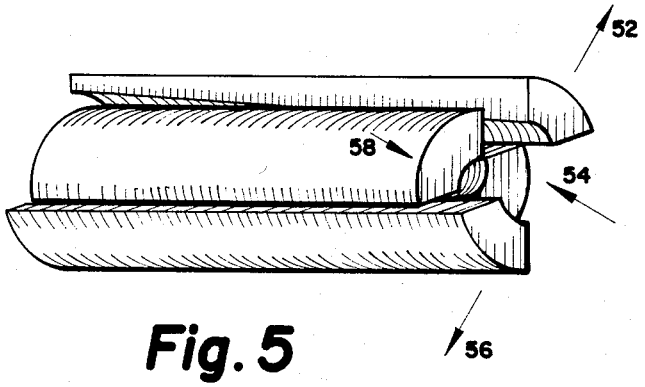
FIG. 5 is a perspective of the invention shown in FIG. 1 wherein the first segments have moved outward and adjacent segments have moved inward.
Figure 6:
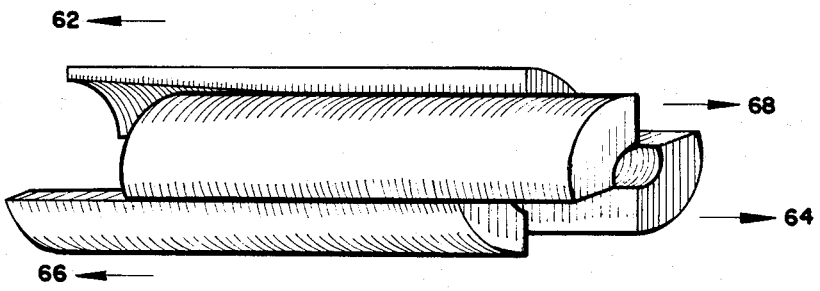
FIG. 6 is a perspective of the invention shown in FIG. 1 wherein the first segments have moved all the way rearward and the adjacent segments have moved all the way forward.

As shown in FIG. 5 at the end of the forward stroke, segments 12 and 16 move out as shown by arrows 52 and 56 as segments 14 and 18 move in as shown by arrows 54 and 58. Thus, segments 12 and 16 release their grip on the cellulosic material and segments 14 and 18 grip the cellulosic material. Segments 14 and 18 then moved forward as shown in FIG. 6 as indicated by arrows 64 and 68, as segments 12 and 16 move back as shown by arrows 62 and 66. Thus, segments 14 and 18 move the cellulosic material forward at the same time heat treating the cellulosic material while segments 12 and 16 move back to position themselves to start the cycle again. The movement from back to forward of each segment is approximately 1 cm or approximately 3% of die 10 length. The die segments are moved in a synchronous manner such that opposing segments move together and forward while opposing segments move out and aft in a conventional manner as is well known in the art. It is not necessary that the movement of the segments perpendicular to the axis and parallel to the axis be made in discrete time frames. Thus the opposing segments may start to move away from the cellulosic material while they are still moving forward.

In the preferred embodiment, the segments always maintain contact with the adjacent segment. This prevents loss of material being treated. However, in some situations, the segments may be separated.

Thus it is seen that carbonizing a cellulosic material as the material is being passed through a heated die may be more readily accomplished by the present invention since no axial drawing force need be applied to the low tensile friable material, nor is any extruding or compressing force applied to the cellulosic material as it enters the inlet of the heated die.

I claim:

1. A die for forming friable material comprising:

a. an axial elongated, segmented mold defining a passage having inlet and outlet ends; and b. moving means capable of independently moving opposed segments of said mold perpendicularly of the axis of said mold and also capable of moving each pair of opposed segments of said mold in a direction parallel to the axis of said mold, wherein said moving means operates opposed segments in a synchronous manner.

2. A die as in claim 1 wherein there are four of said segments.

3. A die as in claim 1 wherein there are an even number of segments.

4. A die as in claim 1 wherein said mold is heated.

5. A die as in claim 1 wherein said mold is tapered so that the inlet is larger than the outlet.

6. A die as in claim 1 wherein all segments of said mold remain in contact with adjacent segments.

* * * * *